United States Patent [19]

Pokhis

[11] 4,331,141

[45] May 25, 1982

[54] ARRANGEMENT FOR PROTECTION OF ORGANS OF RESPIRATION

[76] Inventor: Naum Pokhis, 30-36 Magaw Pl., Apt. 5D, New York, N.Y. 10033

[21] Appl. No.: 28,849

[22] Filed: Apr. 10, 1979

[51] Int. Cl.[3] ..... A62B 7/10

[52] U.S. Cl. ..... 128/204.28; 128/205.22; 128/201.25; 128/205.25; 128/205.13; 128/205.12

[58] Field of Search ..... 128/200.28, 201.23, 128/201.24, 201.25, 204.28, 204.18, 204.21, 204.23, 204.26, 205.12, 205.16, 205.17, 205.22, 205.25, 202.26, 205.18, 205.28, 205.29, 203.28, 205.13

[56] References Cited

U.S. PATENT DOCUMENTS

| | | | |
|---|---|---|---|
| 2,332,662 | 10/1943 | Nathanson | 128/205.12 X |
| 3,347,228 | 10/1967 | Bird et al. | 128/204.26 |
| 3,400,713 | 9/1968 | Finan | 128/204.26 |
| 4,163,448 | 8/1979 | Gronard | 128/205.12 X |

FOREIGN PATENT DOCUMENTS

| | | | |
|---|---|---|---|
| 782137 | 3/1935 | France | 128/205.12 |
| 620266 | 7/1978 | U.S.S.R. | 128/205.25 |

*Primary Examiner*—Henry J. Recla
*Attorney, Agent, or Firm*—Ilya Zborovsky

[57] ABSTRACT

An arrangement for protecting of organs of respiration has a closing element adapted to close the user's nose and mouth, a filtering element communicating with said closing element so that when the user performs inspiration ambient air passes through said filtering element and is cleaned by the latter to be inspirated in cleaned condition, and a device for urging air to flow to and to pass through the filtering element. The device includes an urging element which is actuated in response to the inspiration performed by the user. The device may be formed as a deformable container which is mounted on the user's thorax so that when the user performs inspiration and the volume of thorax increases, the container is deformed and thereby forcedly urges air to the filtering element. The device may also be formed as an impeller driven by an electric motor which is actuated in response to the user's inspiration. The actuation of the electric motor may be performed by a similar deformable container, or by a flap-type switch actuated under the action of inspiration.

2 Claims, 8 Drawing Figures

ARRANGEMENT FOR PROTECTION OF ORGANS OF RESPIRATION

BACKGROUND OF THE INVENTION

The invention relates to individual means for protection of organs of respiration from various detrimental admixtures and can be utilized for protection of an organism from poisonous radioactive substances, during operation in enterprises with polluted air, such as in chemical, coal, metallurgical industries, for protection of population from epidemics of flu and the like, for protection during surgical operations and so on.

Known filtering devices are based on that during inspiration the pressure in lungs decreases, and after this the pressure in a space inside a mask (a respirator) increases. Thereby, air from surrounding atmosphere with a higher pressure flows through filters (filtering cloth) and a valve to organs of respiration. In order to urge air to flow only through the filter, masks of different constructions with firm abutment against parts of a head are put onto a face of the user.

The disadvantages of the conventional means of protection of organs of respiration are the following:

Limited possibility of lungs to cause such a difference of the pressures during inspiration as to clean a sufficient volume of air, in the condition of ever increasing resistance of filtering materials and increasing toxicity of polluted air.

Sucking-in of polluted air along a contour of abutment during an inspiration is not excluded, especially during intensive breathing, for example, during running, working, nervousity and so on.

Firm abutment of the mask against the parts of the head negatively affects normal functioning of skin, troubles the user, limits field of vision.

When the user is in poisonous atmosphere, it is difficult for him to speak.

Individual selection of a mask is necessary for each user.

It is difficult to protect children, especially small children, by firm fitting the mask onto the face.

Sick and elderly people who have heart problems and sick organs of respiration are difficult to be protected by fitting of masks of known constructions.

A user cannot wear masks of known constructions for a long time and must periodically utilize hermetically closed hidings which are expensive and not always available in the vicinity.

During various epidemics, people prefer to be sick than to wear masks of known constructions.

Glass in existing protective masks become sweaty since air which is aspirated is warm and wet.

Accordingly, it is an object of the present invention to provide an arrangement for protection of organs of respiration which avoids the disadvantages of the prior art.

In keeping with these objects and with others which will become apparent hereinafter, one feature of the present invention resides, briefly stated, in an arrangement in which means is provided which is actuated in response to inspiration by a user and is operative for forcedly urging air to and through a filtering element, whereby passing of air through the filtering element under the action of aspiration itself is considerably facilitated.

The novel features of the present invention are specifically defined in the appended claims. However, the invention itself will be best understood from the following description accompanied by the drawing.

DETAILED DESCRIPTION OF PREFERRED EMBODIMENTS

Figure 1:
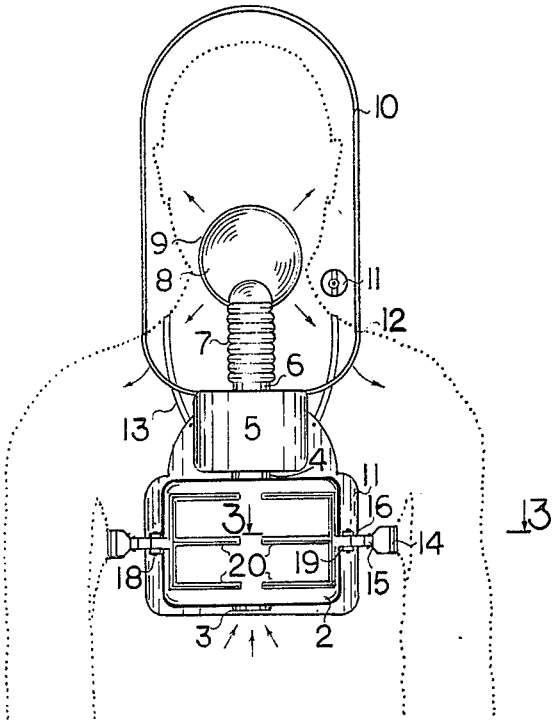
FIG. 1 is a front view of an arrangement for intensive protection of organs of respiration.
Figure 2:
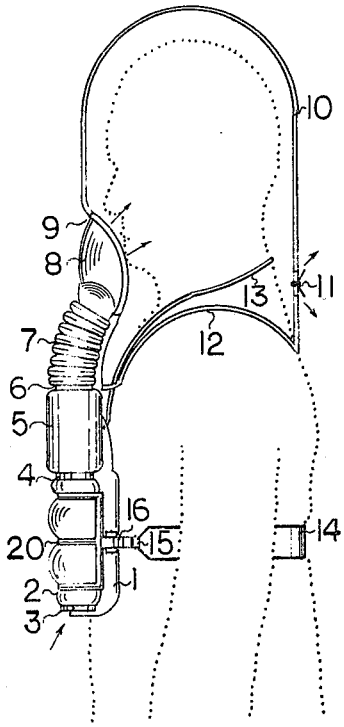
FIG. 2 is a side view of the arrangement shown in FIG. 1.
Figure 3:
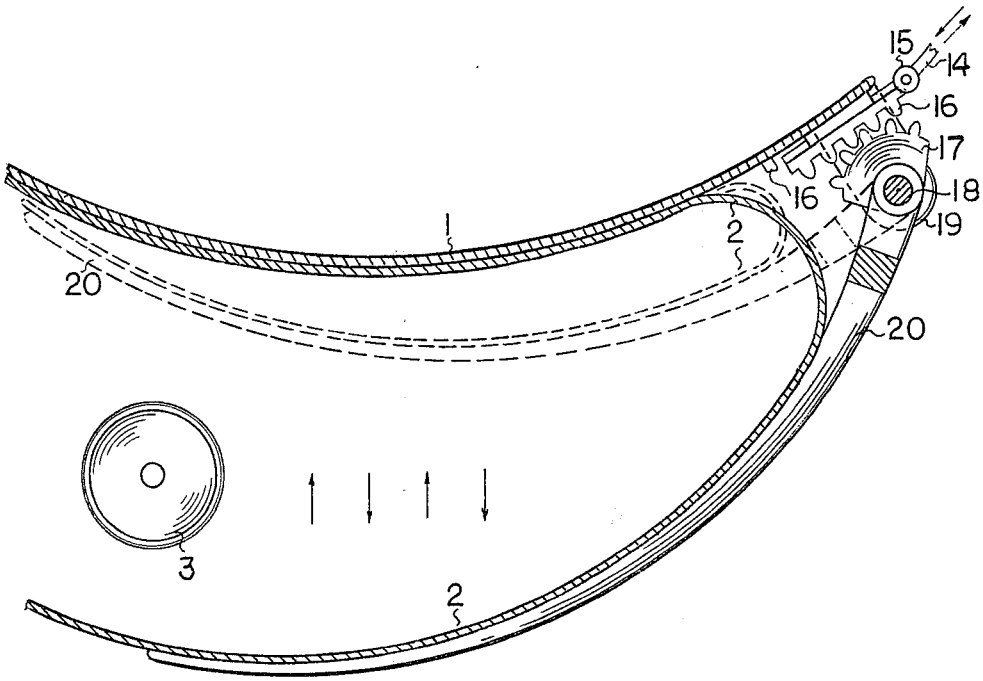
FIG. 3 is a view showing a section of one lateral portion of the arrangement of FIG. 1.

On a panel 1 a rubber bladder 2 is mounted, FIG. 1 and FIG. 2, which bladder has an aspirating valve 3 and an outlet pipe 4 by which latter it is connected with a filter 5. The filter 5 has a throat in which an aspirating valve 6, a crimped pipe 7 and a watering funnel is mounted, the watering funnel 8 being fitted in an opening 9 of a helmet 10. An expirating valve 11 is located in a rear part of the helmet 10, and a sealing edge 12 is provided along the lower contour of the helmet. The device is mounted on a breast with the aid of a strap 13 and a belt 14. The belt 14 (FIG. 3) is connected by a flexible cuff 15 with a toothed rod 16 which has a movement limiting stop 16' and engagement with a segment part 17 pivotal with the aid of an axle 18 in supports 19 which are attached to the panel 1. Spring levers 20 extend from the axle 18 and are located so that three of them are at each half of the bladder 2.

Figure 5:
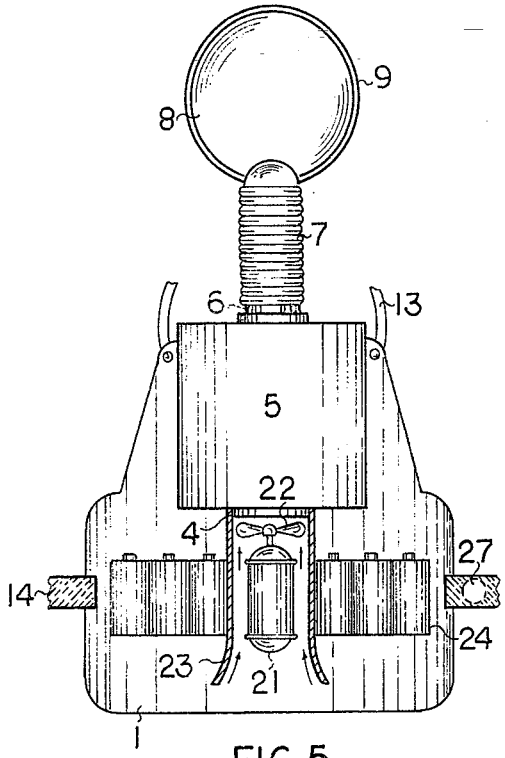
FIG. 5 is a front view of the arrangement for medium protection of organs of respiration.
Figure 4:
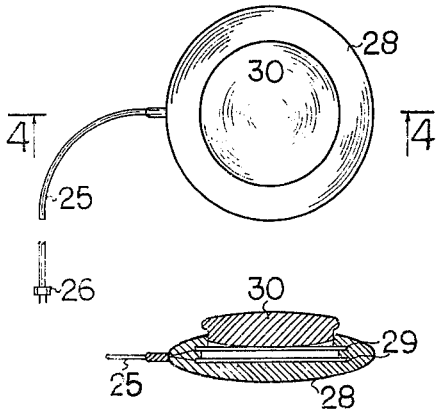
FIG. 4 is top and side views of a contact pendant of an arrangement for medium protection of organs of respiration.

Medium protector for organs of respiration (FIG. 5) with electromechanic blowing during the period of aspiration is composed of an electric motor 21 having an impeller 22 at its axis. The electric motor 21 is mounted in a pipe 23 which is attached through a pipe 4 to the filter 5. The electric motor 21 is supplied from batteries 24 mounted on the panel 1, through the contact pendant (FIG. 4), a conductor 25 and a plug 26. The contact pendant may be accommodated in an inner pocket 27 of the belt 14. The contact pendant (FIG. 4) is composed of a plastic body 28, two parallel secured metallic plates 29, and a stop 30 which is adjustable with the aid of a thread.

Figure 6:
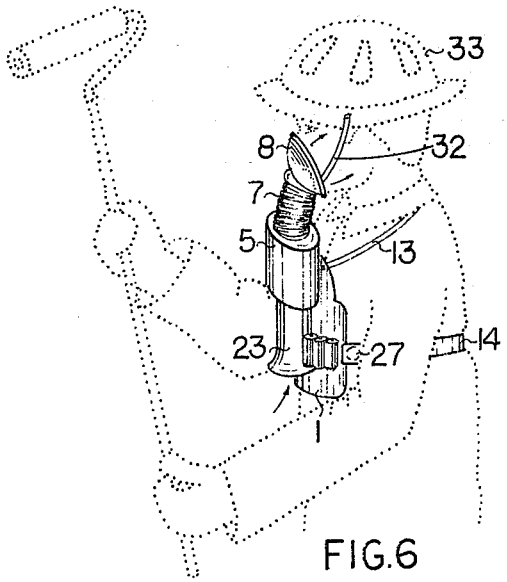
FIG. 6 is a side view of the arrangement shown in FIG. 5.

Medium protector for organs of respiration with electromechanic blowing during an inspiration (FIG. 6) is composed of the device which is suspended on a neck with the aid of the strap 13 and pulled to a body by the belt 14. The watered funnel 8 is located as close as possible to a mouth and nose of the user (without contact with a face) and can be additionally secured by a flexible connection 32 to a working helmet 33.

Figure 7:
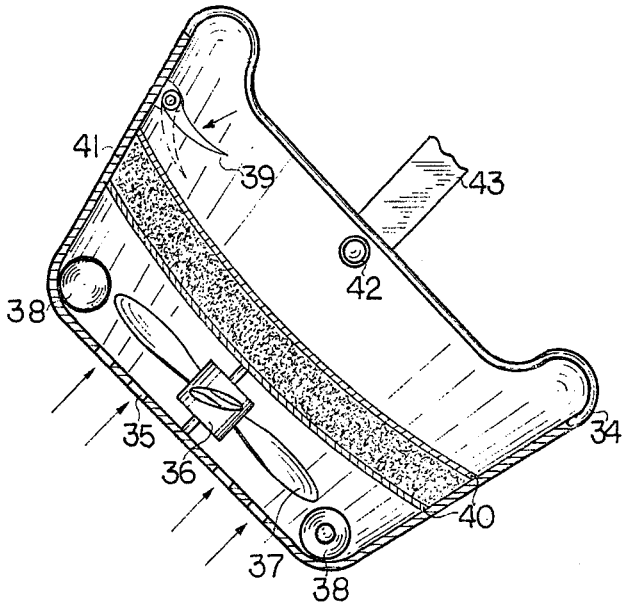
FIG. 7 is a view showing a section of an arrangement for lightened protection of organs of respiration.

Lightened protector for organs of respiration with electromechanic blowing (FIGS. 7 and 8) is composed of a body 34 which has at the side of its bottom, openings 35, an electric motor 36 whose stator carries spiral vanes 37, supply batteries 38, and a flap switch 39. A replaceable filter 41 having respective protection in dependence upon characteristic of air contamination is located above the electric motor 36 between two nets 40. Mounting means 42 is located at the side of the body 34 for connecting the same with a head arc member 43.

OPERATION OF THE DEVICE

Intensive protection of organs of respiration is performed in condition of high toxicity of surrounding medium, and in order to prevent damage to a person it is needed to act in the following manner:

The panel 1 is put onto the user and secured outside of the outer clothes by the strap 13 and the belt 14 so that during inspiration the bladder is compressed and during expiration it restores its volume. Then the helmet 10 is put onto the head so that its sealing edge 12 is placed against the shoulders, and the watering funnel 8 is firmly inserted into the opening 9.

During inspiration the user's thorax expands and as a result of this the belt 14 is strained so that the toothed rods 16 are pulled through the flexible cuffs 15 and thereby the segment parts 17 turn together with axles 18. The spring levers 20 secured to the axles 18 at each side, press the bladder 2 to the panel 1. Since the valve 3 of the bladder 2 is an aspirating valve, air cannot pass through the valve and flows through the outlet pipe 4 in the filter 5, wherein air is cleaned from detrimental admixtures and moves further through the valve 6, the crimped pipe 7, and then air gets through the watering funnel into the area of the mouth and nose.

The supply of cleaned air in the area of the mouth and nose synchronically coincides with rarification which takes place, and then it unimpededly fills the lungs. The deeper is inspiration, the larger amount of air is supplied into the area of the mouth and nose and the larger amount of air is aspirated by the lungs. During expiration the thorax reduces its volume and the strain of the belt 14 respectively weakens. As a result of elasticity of the rubber bladder 2, it comes to its initial volume and sucks thereby through the valve 2 a next portion of contaminated air. The spring levers 20 return to their initial position, at the same time the axles 18 turn and the segment parts 17 also turn with them. Since the latter are in engagement with the toothed rods 16 they turn them to the initial position for repetition of the cycle of respiration.

In order to facilitate breathing (if a user is sick or weak) and when batteries are available, the bladder 2 with the system of levers can be replaced by a block (FIGS. 5 and 6) which is composed of an electric motor 21 with an impeller 22 located in the interior of a pipe 23 and a set of batteries 24. Energizing of the electric motor 21 during the inspiration is performed with the aid of a contact pendant (FIG. 4) which operates in the following manner: When the pendant is accommodated in the inner pocket 27 of the belt 14 or at any other part of the user's body which is movable during breathing, such as on a breast under the panel 1, on a stomach and the like, the pendant is subjected to compression during inspiration. The body 28 is manufactured from a flexible synthetic plastic material or rubber and is deformed so as to connect the metallic plates 29 which energize the electric motor 21 through the conductor 25. During expiration the pressure against the contact pendant weakens, and the plates 29 disengage so as to switch off the operation of the electric motor 21. A required distance between the metallic plates 29 is adjusted by an oval stop 30 with the aid of a thread 31.

Medium protector for organs of respiration is utilized when toxicity of air is not lethal, but prolonged presence in such an atmosphere may cause irrepairable harm to health. In this situation it is not necessary to utilize the helmet 10 as shown in FIG. 1 and FIG. 2, but it is sufficient to put the device onto the breast and to fix the watering funnel by the flexible connection 32—FIG. 6, so that is does not contact the face and at the same time the mouth and nose are in a stream of filtered air.

Figure 8:
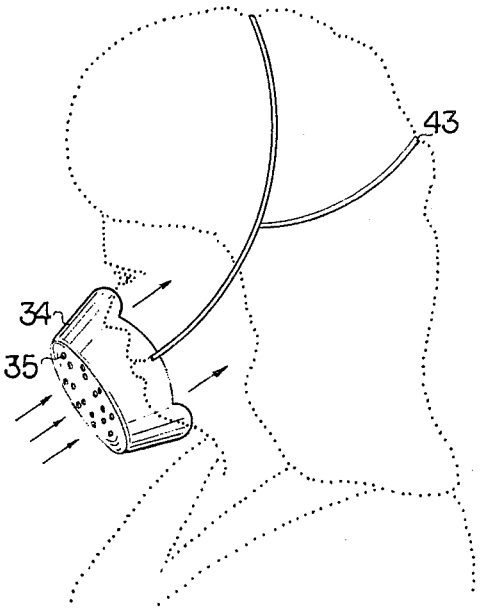
FIG. 8 is a side view of the arrangement of FIG. 7 in working position.

Lightened protector for organs of respiration (FIGS. 7 and 8) are utilized when air is a little contaminated, however, its inspiration without a filter caused irritation, and also it is desirable to protect the smell of a person from unpleasant odours. In additional to this, such a light protector for equipped by a special filter would decrease during various epidemics a number of sick people, when the filter renders harmless viruses, so that spreading of sickness could be limited. The lightened protector for is utilized in the following manner:

The body 34 is fixed to the head arc 43 with the aid of the mounting member 42, so that the body is maximum close to the face, and the mouth and nose of a user are dipped in the body 34, see FIG. 8. When inspiration takes place, the flap switch 39 connects the batteries 38 with the electric motor 36, rotates the vanes 37 and urges air to flow through the openings 35 and the filter 41 into the area of mouth and nose.

In order to reduce the weight and dimensions of the lightened protector for organs of inspiration, the supply batteries can be located, for example, in a pocket; or during immovable operation relative to a source it is possible to get electric energy from the motor 36 through a cable, for example during the operation in a car, at a machine tool and so on. Besides, when the device source of supply is separate, the device can be so light weighted that it can be worn as glasses so that the body 34 covers the mouth and nose.

In conventional systems, lungs cause rarification and only by this perform all work which is necessary to aspirate air through the filter and to overcome resistance of valves and other parts. The inventive arrangement no longer uses this principle and thereby eliminates the above-mentioned disadvantages.

Muscle force of thorax supplies more air and overcomes easier the resistance of the filter and other part than the pure rarification in lungs during usual inspiration.

The proposed system excludes leakage of air into a mask since the latter is subjected to excessive pressure.

It is not necessary that the mask tightly abut against parts of head, since for the same reason as in part 2, air is supplied with excessive pressure.

When the user utilizes the proposed protector for organs of respiration (FIG. 6 or FIG. 8), it is possible to speak, and words of the user will be heard, since a gap exists between the face and the proposed protection.

Since the proposed system does not have individual masks, there is no problem of individual selection.

Children can wear one of the kinds of protection of organs of respiration of reduced dimensions in dependence upon toxicity of surrounding medium.

The inventive arrangement does not use masks which firmly abuts the user, and the supply of air is performed by electric energy (from batteries or network), and therefore sick people do not encounter any inconveniences during use of the inventive arrangement.

Since the arrangement does not include the above-mentioned firmly abutting masks, the use can be in poisonous atmosphere for a relatively long time, and it is not necessary for him to stay in hiding (it is sufficient to use hiding only to replace the filters periodically.

The inventive arrangement, especially of the lightened type, is easy to utilize and has a low weight, whereby people can wear the same like glasses.

As a result of intensive circulation of air with ambient temperature, FIG. 1 and FIG. 2, the helmet 10 will not get misted from inside.

When in the arrangement of FIG. 8 the electric motor 38 is reversible, the arrangement can be utilized during surgical operations instead of existing masks in which a sick man must overcome resistance of filtering fabric by work of his lungs.

Whereas in the conventional arrangements the inspiration is performed purely by rarification cause by the user's lungs, the inventive arrangement provides for considerable aid to the user since in the inventive arrangement muscle force of thorax expansion or external source of energy are utilized to render this aid.

It will be understood that each of the elements described above may also find a useful application in other types of constructions differing from the types described above.

While the invention has been illustrated and described, it is not intended to be limited to the details shown since various modifications and structural changes may be made without departing in any way from the spirit of the present invention.

Without further analysis, the forgoing will so fully reveal the gist of the present invention that others, by applying current knowledge can readily adapt it for various applications without ommiting features that, from the standpoint of the prior art, fairly constitute essential characteristics of the generic or specific aspects of this invention.

What is claimed as new and desired to be protected by Letters Patent is set forth in particular in the appended claims:

1. An arrangement for protecting organs of respiration, comprising a closing element adapted to close the user's nose and mouth;

a filtering element communicating with said closing element so that ambient air can pass through said filtering element to be cleaned therein and thereafter supplied in cleaned condition into said closing element to be aspirated by the user;

means for forcedly urging the ambient air to flow and to pass through said filtering element, said means including an urging element actuated in response to the inspiration performed by the user, and formed as a deformable container which has an inner chamber including one way valve means providing one way flow of ambient air into said chamber and an outlet connected with said filtering element; and means for mounting said deformable container on the user's thorax so that when the user performs inspiration and the volume of thorax increases, said container is deformed and the volume of said inner chamber decreases whereby the ambient air which enters said inner chamber of said container is urged to flow to and through said filtering element.

2. An arrangement as defined in claim 1; and further comprising a rigid member which is displaced in response to the increases of the volume of the user's thorax, secured to and in abutting relation against said deformable container so as to deform the latter and to thereby reduce the volume of said inner chamber.

* * * * *